US010111467B1

(12) United States Patent
Arnel et al.

(10) Patent No.: US 10,111,467 B1
(45) Date of Patent: Oct. 30, 2018

(54) WEARABLE ELECTRONIC SIMULATED SMOKING DEVICE WITH INTERCHANGEABLE VAPORIZATION CARTRIDGES

(71) Applicants: Scott M. Arnel, Oyster Bay, NY (US); Eric Schmiesing, Syosset, NY (US)

(72) Inventors: Scott M. Arnel, Oyster Bay, NY (US); Eric Schmiesing, Syosset, NY (US)

( * ) Notice: Subject to any disclaimer, the term of this patent is extended or adjusted under 35 U.S.C. 154(b) by 606 days.

(21) Appl. No.: 14/796,563

(22) Filed: Jul. 10, 2015

Related U.S. Application Data

(63) Continuation-in-part of application No. 14/223,421, filed on Mar. 24, 2014, now Pat. No. 9,820,508.

(51) Int. Cl.
*A24F 47/00* (2006.01)
*H05B 1/02* (2006.01)

(52) U.S. Cl.
CPC ..... *A24F 47/008* (2013.01); *H05B 1/0244* (2013.01)

(58) Field of Classification Search
CPC .... A24F 47/008; H05B 1/0244; A61M 15/06; A44C 5/0023; A44C 9/0053; A44C 13/00
See application file for complete search history.

(56) References Cited

U.S. PATENT DOCUMENTS

| | | | | |
|---|---|---|---|---|
| 839,047 | A | 12/1906 | Sylvester | |
| 5,622,293 | A | 4/1997 | Lefevre | |
| 6,854,470 | B1 | 2/2005 | Pu | |
| 8,156,944 | B2 | 4/2012 | Han | |
| 8,205,622 | B2 * | 6/2012 | Pan | A24F 47/008 131/273 |
| 8,490,628 | B2 | 7/2013 | Hon | |
| 8,511,318 | B2 | 8/2013 | Hon | |
| 8,528,569 | B1 | 9/2013 | Newton | |
| 2010/0200006 | A1 | 8/2010 | Robinson et al. | |
| 2011/0265806 | A1 | 11/2011 | Alarcon et al. | |
| 2011/0277764 | A1 | 11/2011 | Terry et al. | |
| 2011/0277780 | A1 | 11/2011 | Terry et al. | |
| 2012/0118301 | A1 | 5/2012 | Montaser | |
| 2012/0204889 | A1 | 8/2012 | Xiu | |
| 2012/0214380 | A1 | 8/2012 | Vine, III | |
| 2013/0247924 | A1 | 9/2013 | Scatterday et al. | |
| 2014/0007891 | A1 | 1/2014 | Liu | |

* cited by examiner

*Primary Examiner* — Michael H. Wilson
*Assistant Examiner* — Dionne W. Mayes
(74) *Attorney, Agent, or Firm* — Rosenberg, Klein & Lee

(57) ABSTRACT

A wearable electronic simulated smoking device (500, 500') is provided for delivery of a desired active ingredient responsive to a user's inhalation through the device (500, 500'). The device (500, 500') includes an elongated tubular body (110) having at least one arcuate portion to at least partially encompass a portion of a user's body and is releasably retainable thereat. Tubular body (110) includes a cartridge receiving housing (510) having a cartridge receiving chamber (514) in to which any one of multiple vaporization cartridges (520, 520', 520") may be removably received. Device (500, 500') includes vaporization cartridges (520, 520', 520"), each including a vaporizer (145, 530, 560) for generating vapors from liquid and wax concentrates, and dry herbal compositions.

8 Claims, 14 Drawing Sheets

WEARABLE ELECTRONIC SIMULATED SMOKING DEVICE WITH INTERCHANGEABLE VAPORIZATION CARTRIDGES

CROSS REFERENCE TO RELATED APPLICATIONS

This application is a continuation-in-part application of U.S. patent application Ser. No. 14/223,421, entitled "WEARABLE ELECTRONIC SIMULATED SMOKING DEVICE", filed on 24 Mar. 2014, currently pending.

BACKGROUND OF THE INVENTION

This disclosure directs itself to a wearable electronic simulated smoking device that provides convenient storage and use as an alternative to inhalation of the smoke from burning a composition containing a desired active ingredient. More in particular, the disclosure is directed to a wearable electronic simulated smoking device that includes a tubular body that is configured to at least partially encompass a portion of a user's body and thereby be easily transported by the user. Still further, the disclosure is directed to a wearable electronic simulated smoking device where the tubular body has at least a portion thereof which is reversibly bendable into, or out of, an arcuate contour. Further, the tubular body may include at least one portion having a fixed contour as well as at least one portion that is reversibly bendable. Further yet, this disclosure is directed to a wearable electronic simulated smoking device that includes a tubular body that is configured to receive replaceable, interchangeable vaporization cartridges. The interchangeable vaporization cartridges permit the wearable electronic simulated smoking device to be used with compositions that are in the form of dry herbaceous materials, waxes, and liquids, including oils.

Electronic simulated smoking devices, commonly known as e-cigarettes or e-cigs, came into being in the early 1960's. These simulated smoking devices have grown in acceptance and popularity because it is believed that they are less toxic to the user than the conventional method of inhaling a desired active ingredient through burning a source of that ingredient and inhaling the products of that combustion, including carcinogens. Without the toxic products of combustion being present, there is a greatly reduced concern about "secondhand smoke," as well. They have also grown in popularity due to people's fascination with gadgetry.

Nevertheless, there has not been a new or fashionable way of transporting or storing these devices on one's person. They are often carried loose or in cases that are put in a user's pocket or handbag. Unlike a conventional cigarette, cigar or pipe that typically and most easily is ignited and burned until the substance carrying the active ingredient is substantially consumed, the e-cigarette can be used intermittently. The e-cigarette is inactive whenever no inhalations are being made through the device and can be stored on the user's person. Rather than burning the substance carrying the active ingredient, the e-cigarette vaporizes the material utilizing an indirect heating process, such as conduction or convection. In this manner even dry herbaceous materials can be used in an intermittent fashion. Because of the wide variety of types and forms of vaporizable materials, e-cigarette vaporizers likewise come in different forms. Thus, there is a need for a more convenient storage and transport mechanism for electronic simulated smoking devices and a need for those devices to be adaptable to for use with different types of vaporizers and vaporizable materials.

SUMMARY OF THE INVENTION

A wearable electronic simulated smoking device is provided that includes an elongated tubular body having at least a portion thereof being bendable for the tubular body to at least partially encompass a portion of a user's body. The tubular body has a cartridge receiving chamber formed therein and the cartridge receiving chamber has an open distal end. The wearable electronic simulated smoking device further includes a power supply disposed in the tubular body, and a controller disposed in the tubular body coupled to the power supply. The controller is configured to output an energization signal. Still further, the wearable electronic simulated smoking device includes a vaporization cartridge removably received within the cartridge receiving chamber. The vaporization cartridge includes a housing configured for releasable coupling to the cartridge receiving chamber. The housing has a perforate first end configured for electrical coupling to the controller, a suction opening at an opposing second end and a fluid flow path extending therebetween. Further the vaporization cartridge includes a vaporizer that has a heat source and a supply of a vaporizable material. The heat source vaporizes the vaporizable material responsive to the energization signal from the controller. The vaporizer is disposed in fluid communication with the fluid flow path for dispensing vapors from vaporizable material to the fluid flow path.

From another aspect, a wearable electronic simulated smoking device is provided that includes an elongated tubular body configured to at least partially encompass a portion of a user's body with at least one arcuate shaped portion. The tubular body has a cartridge receiving chamber formed therein. The wearable electronic simulated smoking device further includes a power supply disposed in the tubular body, and a vaporization cartridge removably received within the cartridge receiving chamber. Further, the wearable electronic simulated smoking device includes a controller disposed in the tubular body coupled to the power supply. The controller outputs an energization signal to the vaporization cartridge to control power delivered thereto. The vaporization cartridge includes a housing configured for releasable coupling to the cartridge receiving chamber. The housing has a perforate first end configured for electrical coupling to the controller, a suction opening at an opposing second end and a fluid flow path extending therebetween. The vaporization cartridge further includes a vaporizer including a heat source and a supply of a vaporizable material. The heat source vaporizes the vaporizable material responsive to the energization signal from the controller. The vaporizer is disposed in fluid communication with the fluid flow path for dispensing vapors from vaporizable material to the fluid flow path.

DETAILED DESCRIPTION OF THE PREFERRED EMBODIMENTS

Referring to FIGS. 1-12, there is shown a wearable electronic simulated smoking device 100, 100', 100" for convenient storage and use as an alternative to inhalation of the smoke from burning a composition containing a desired active ingredient. Wearable electronic simulated smoking device 100, 100', 100" includes a unique housing in the form of a tubular body 110 that is configured to at least partially encompass a portion of a user's body and thereby be easily transported by the user. While being worn, wearable electronic simulated smoking device 100, 100', 100", in some instances, can be used to deliver a desired active ingredient through inhalation by the user through that device.

Figure 2:
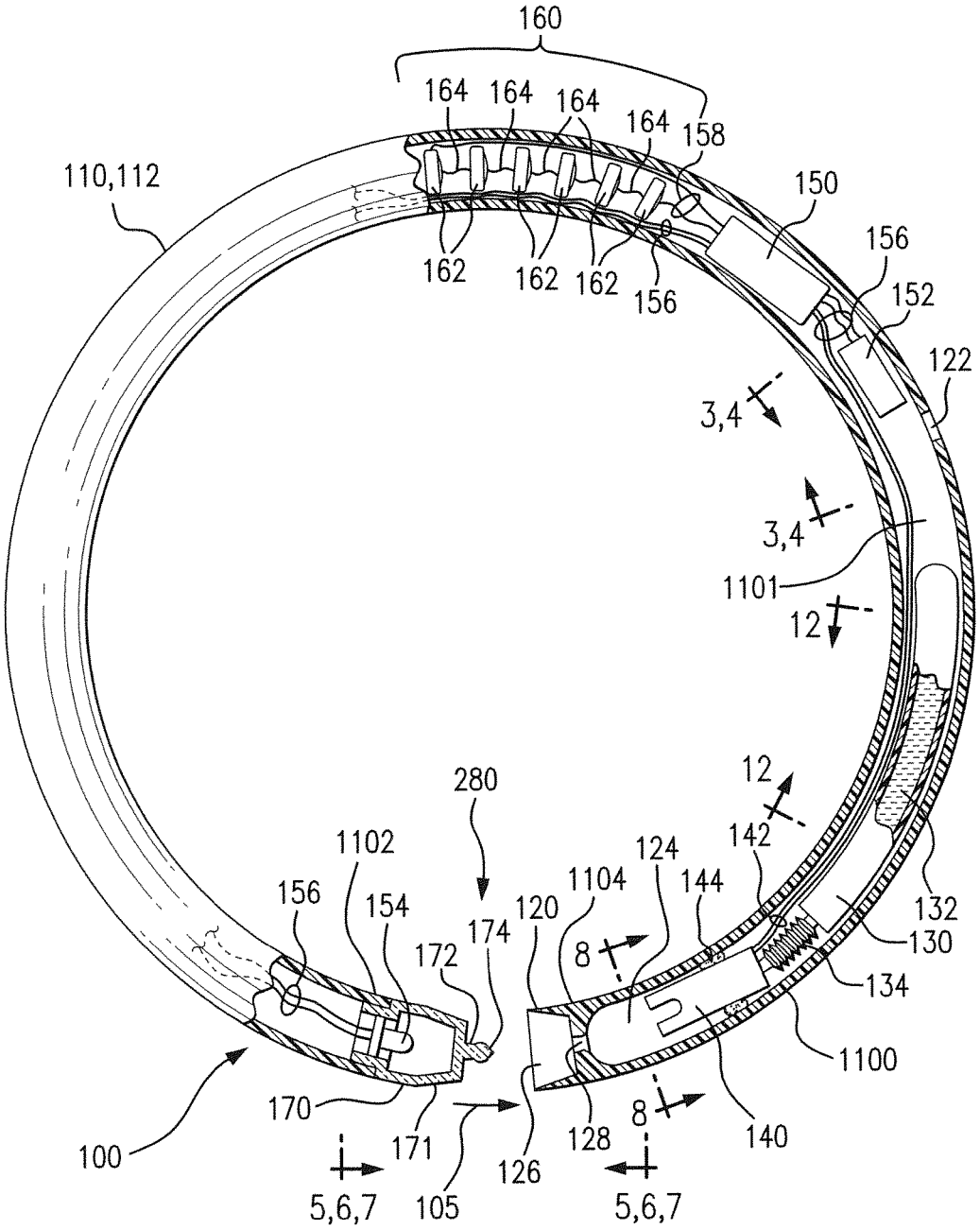
FIG. 2 is a schematic illustration, partially cut-away, of another configuration of the present invention in a bent contour.
Figure 2A:
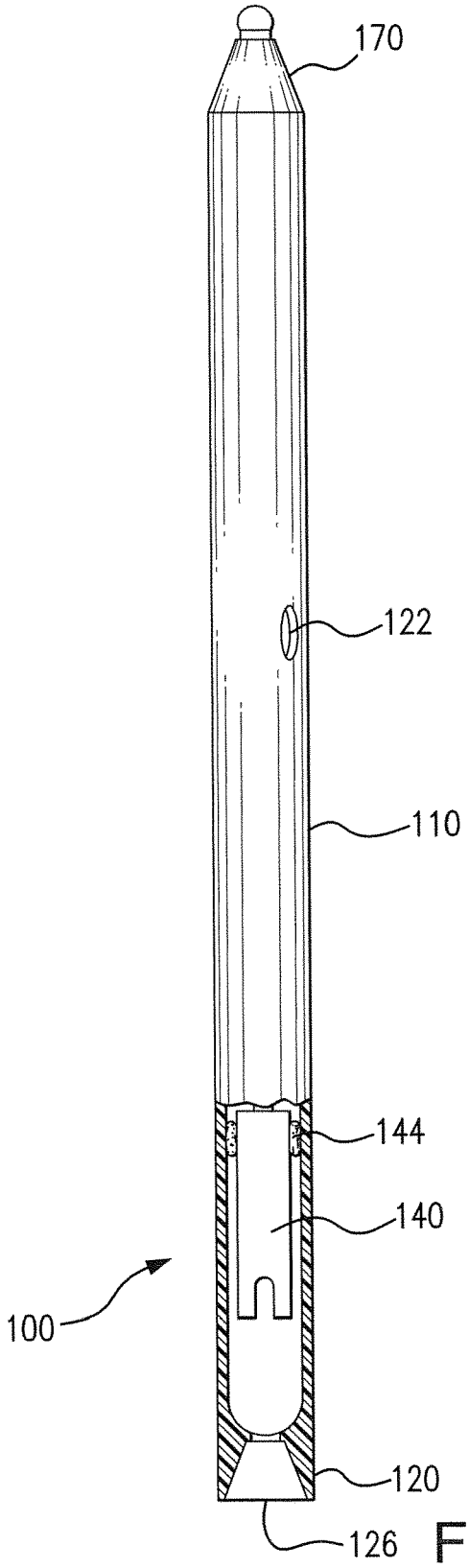
FIG. 2A is an illustration of the configuration shown in FIG. 2 in a straightened contour.

Referring now to FIGS. 2 and 2A, there is shown schematic illustrations of a wearable electronic simulated smoking device 100. Wearable electronic simulated smoking device 100 includes an elongated tubular housing 110, a portion of which 112 is reversibly bendable into, or out of, an arcuate contour. In the particular configuration shown, the bendable portion 112 is defined by substantially the entire extent of the tubular body 110. As will be described in following paragraphs, the bendable portion 112 of tubular body 110 may be formed of various plastic or metallic materials having properties and/or structural arrangements providing the necessary pliancy to be reversibly bendable, either elastically or inelastically.

FIG. 2A illustrates the wearable electronic simulated smoking device 100 arranged for use. The tubular body 110 is straightened longitudinally from its arcuate storage configuration shown in FIG. 2, allowing a user to easily access the mouthpiece portion 120. The user can then inhale through the suction opening 126 to obtain delivery of a liquid smoking composition in the form of an aerosol or vapor carried by air drawn into the tubular body through the air inlet opening 122. Each time a user inhales through the suction opening 126, the light transmissive end cap 170 is illuminated in correspondence therewith.

The operation of wearable electronic simulated smoking device 100 is best understood by referring back to FIG. 2. Wearable electronic simulated smoking device 100 includes a hollow tubular body 110 housing the components that store a smoking liquid composition 132 and provide the means to deliver the composition 132 to the air inhaled through the device by the user. The components that are combined to form an electronic simulated smoking device, commonly referred to as an e-cig or e-cigarette, are well known in the art and thus their particular structures will not be described in detail, other than where modifications have been incorporated therein to accommodate the bendability of the tubular body 110 or portions thereof.

Wearable electronic simulated smoking device 100 includes a supply of a smoking liquid composition 132 within a fluid container 130. The smoking liquid composition contains an active ingredient intended to be inhaled, such as a nicotine solution, a mixture of nicotine and flavorings and/or aromatic compositions, and where legally permitted, a tetrahydrocannabinol (THC) solution, a mixture of THC and flavorings and/or aromatic compositions, and combinations thereof, as examples. The supply of the smoking liquid composition 132 may be stored as liquid within fluid container 130 or absorbed in a porous material disposed in fluid container 130. Fluid container 130 is formed of a flexible plastic material so that it is able to conform to the contour of the internal bore 1101 of the bendable portion 112 of tubular body 110 when that portion is bent into an arcuate contour. The outer diameter of the fluid container 130 is sufficiently smaller than the inner diameter of internal bore 1101 so that air drawn therein through the air inlet opening 122 can pass by the fluid container. Alternately or in addition thereto, the wall of fluid container 130 may be formed with longitudinally extending air channels. The smoking liquid composition 132 is output to the nebulization chamber 140 through a flexible conduit 134. As is known in the art, the flow of the liquid smoking composition to or within the nebulization chamber is controlled by a valve (demand type or controlled by the controller 150) or through the use of a wick that supplies the liquid through capillary action on, for all practical purposes, a demand basis.

The flexible conduit 134 may be formed of a flexible material, such as silicone, polyvinyl chloride, nylon, neoprene, polyurethane, or natural and synthetic rubber, to name a few. More rigid materials can be made sufficiently flexible by constructing conduit 134 with an accordion or bellows type wall contour, as illustrated in FIG. 2. As an alternative to a single flexible fluid container 130, a segmented fluid container 130', shown in FIG. 12, may be substituted. Fluid container 130' consists of container sections 136 fluidly connected in series by respective flexible container conduits 138. Each flexible container conduit 138 may be formed of like materials and/or constructed as was described for flexible conduit 134, including provisions for allowing air to pass along the outer sides of the container walls.

As used herein, the term "nebulization" refers to a process for conversion of a liquid into a spray, aerosol, mist or vapor, by either atomization or vaporization mechanisms. Nebulization chamber 140 may be of the type that vaporizes the liquid smoking composition 132 supplied thereto through the use of an internal heating element, or the type that atomizes the liquid smoking composition 132 using an ultrasonic transducer, such as a piezoelectric transducer, to create an aerosol. Both types of nebulization chambers are well known in the electronic cigarette art and thus the internal structure and theory of operation are not being described herein. Nebulization chamber 140 is disposed in the internal bore 1101 of tubular body 110 and is sufficiently smaller in diameter than internal bore 1101 to be accommodated therein when such is disposed in an arcuate contour. As is typical for such devices, nebulization chamber 140 is provided with air inlet openings on a rear portion thereof (not shown) and the portion of internal bore 1101 in which nebulization chamber 140 is disposed is defined as the fluid flow path. Fluid flow path 124 extends from the air inlet opening 122, past the outer wall of the fluid container 130, 130', through the nebulization chamber 140 to the suction opening 126. An annular seal 144 encompasses the nebulization chamber 140 to block air from bypassing passage through nebulization chamber 140.

A controller 150 is provided to control the operation of the nebulization chamber 140 in response to inhalation by a user. Such controllers are commonly used in conventional e-cigarettes and may be in the form of a microprocessor or a digital, analog or hybrid system on chip (SOC). Controller 150 has an input coupled to a sensor 152 via a pair of the plurality electrical wires 156 connected to controller 150. The sensor 152 is located in fluid communication with the fluid flow path 124 for detecting a reduction in air pressure in fluid flow path 124, as an indication of a user drawing in air from the suction opening 126. Responsive to detection of the pressure drop, controller 150 energizes the nebulization chamber 140 through the electrical wires 142 to deliver the liquid smoking composition/air mixture to the user as the user inhales through the suction opening 126 of the mouthpiece 120. The mouthpiece 120 may be connected to the tubular body 110 or integrally formed therewith.

Responsive to the detection of a user's inhalation through the device 100, controller 150 energizes a light emitting diode (LED) 154 via another pair of the plurality electrical wires 156 connected to controller 150. LED 154 is disposed at the distal end 1102 of tubular body 110, but could be located at any desired location. End cap 170 is coupled to the distal end 1102 of tubular body 110 and is light transmissive to serve to both permit visualization of illumination from LED 154 and provide releasable coupling with the opposing proximal end 1104 of tubular body 110, to be further described in following paragraphs. The optical property of end cap 170 may range from transparent to varying levels of translucency. To enable the energization of the nebulization chamber 140 and LED 154, a power supply 160 is connected to controller 150 by means of a pair of wires 158. Power supply 160 is formed by a plurality of batteries or cells 162 that may be connected in series, parallel or a combination of series and parallel by means of one or more interconnection leads 164 (depending on the connection arrangement of the batteries). Each interconnection lead 164 is a flexible electrical wire having a stranded or braided construction to allow for displacement of the batteries 162 when the contour of the internal bore 1101 changes in response to bending tubular body 110.

A tubular body 110 with one or more bendable portions 112 provides the ability of the electronic simulated smoking device 100 to be formed by a user into a contour that at least partially encompasses a portion of the user's body so that it can be worn as an ornament or an accessory. Depending upon the length and/or diameter of tubular body 110, device 100 can be worn about such body portions as the neck, wrist, or finger, as examples. It is contemplated that anywhere a user wears ornamentation or accessories, device 100 can be configured to be similarly worn thereat.

As shown in FIG. 2, tubular body 110 may be reversibly bent into an annulus to encompass such bodily structures as a user's neck or wrist. The tubular body is maintained about the user using a releasable coupling 280 formed by complementary elements at the opposing end portions 1102 and 1104 of tubular member 110 and is releasably retainable thereat. End cap 170 is formed with an end portion 171 having a contour corresponding to an internal contour of the suction opening 126 of the mouthpiece portion 120 to be received therein. End cap 170 has a projection 172 extending therefrom with a locking head portion 174 at the distal end thereof. When the end portion 171 of end cap 170 is received in the suction opening 126, the projection 172 locates the locking head 174 so that it releasably lockingly engages the mouthpiece through opening 128. By this arrangement, the electronic simulated smoking device 100 can be conveniently carried by a user on the user's person; worn as a fashion accessory when not in use.

Figure 5:
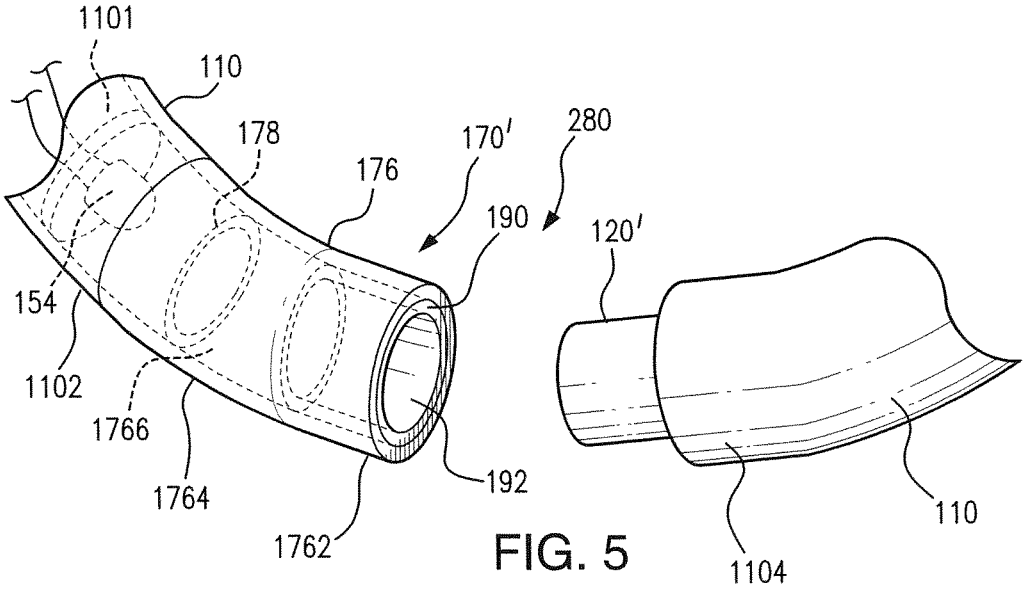
FIG. 5 is an enlarged partial view taken along the section line 5-5 in FIG. 2 showing an alternate coupling structure of the tubular body.

Other complementary elements at the opposing end portions 1102 and 1104 of tubular member 110 can be utilized to provide a releasable coupling 280 to maintain the tubular body 110 about a portion of the user's body. For example, as shown in FIG. 5, the proximal end 1104 of tubular body 110 may be coupled to a mouthpiece 120' formed of a metallic composition containing a ferrous metal. The opposing distal end 1102 of tubular body 110 is fitted with an end cap 170' formed by a light transmissive tubular member 176. The light transmissiveness of tubular member 176 can range from transparent to varying levels of translucency. Tubular member 176 is coupled to the distal end 1102 of tubular member 110 by means of a coupling sleeve 178 affixed within the internal bore 1101 of tubular member 110 and extending into the internal bore 1766 of tubular member 176 to be affixed thereat. Within the internal bore 1766 of tubular member 176 adjacent the receiving end 1762 there is disposed an annular magnet 190. Thus, the mouthpiece 120' is inserted into the opening 192 at the receiving end 1762 of tubular member 170' to be magnetically held thereat. A user is able to release the coupling of the distal end 1104 of tubular body 110 from the tubular member 176 by applying a sufficient tensile force therebetween to overcome the magnetic attraction between the annular magnet 190 and the metallic mouthpiece 120'. When device 100 is in use, illumination from LED 154 is emitted through the opening 192 and an illumination region 1764 located between a rear end of the annular magnet 190 and, at least, a tubular member facing end of the coupling sleeve 178. The illumination region 1764 may be expanded in size through the use of a coupling sleeve 178 formed of a light transmissive material.

Figure 6:
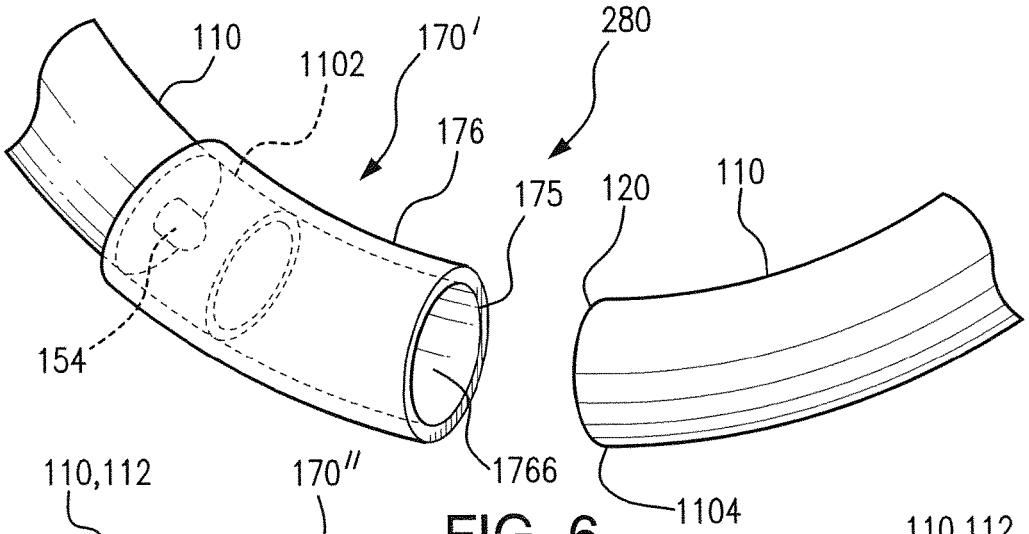
FIG. 6. is an enlarged partial view taken along the section line 6-6 in FIG. 2 showing another alternate coupling structure of the tubular body.

Another alternative arrangement of releasable coupling 280 is shown in FIG. 6. Here, the end cap 170' includes a tubular member 176 having an internal bore 1766 into which the distal end 1102 of the tubular body 110 is received and affixed thereat. As in the example of FIG. 5, tubular member 176 is formed of a material that has a light transmissiveness that can range from transparent to varying levels of translucency to emit illumination from the LED 154. The mouthpiece 120 portion of tubular body 110 at the proximal end 1104 thereof is insertable into the opening 175 to be received and frictionally engaged within the internal bore 1766 of the tubular member 176. A user is able to easily release the coupling of the distal end 1104 of tubular body 110 from the tubular member 176 by applying a sufficient tensile force therebetween to overcome the frictional engagement between the tubular member 176 and the mouthpiece 120.

Figure 7:
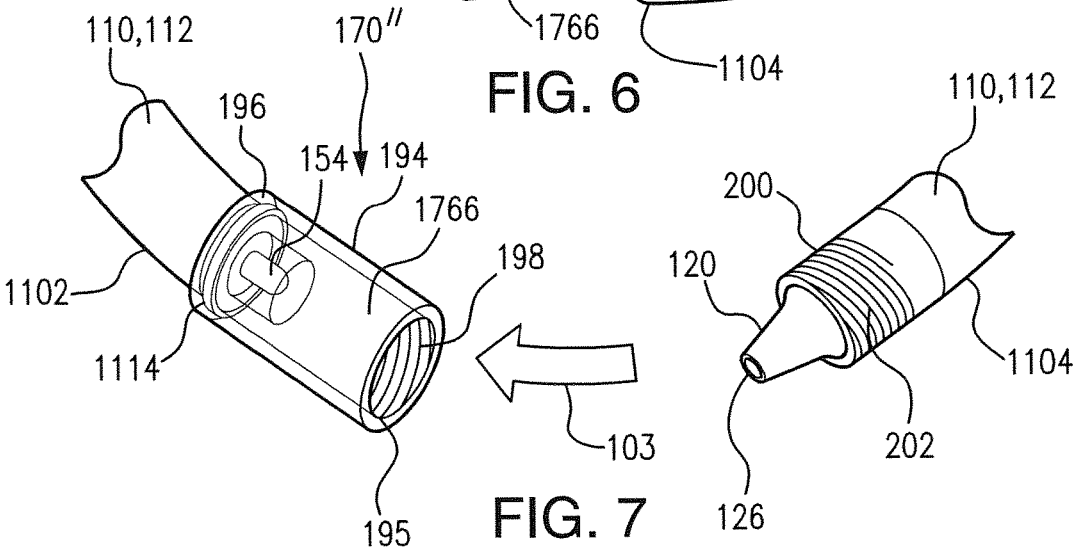
FIG. 7 is an enlarged partial view taken along the section line 7-7 in FIG. 2 showing a further alternate coupling structure of the tubular body.

A further alternative arrangement of releasable coupling 280 is shown in FIG. 7. The arrangement illustrated in FIG. 7 is particularly useful where the bendable portion 112 of tubular body 110 is formed of a metallic material. Here, an end cap 170" provides threaded releasable engagement with a connector 200 affixed to the proximal end 1104 of tubular member 110. End cap 170" includes a coupling 194 rotatably affixed to the distal end 1102 of tubular body 110. The proximal end 1104 of tubular body 110 is coupled to a connector 200 from which the mouthpiece 120 extends. Connector 200 has external threads 202 formed thereon.

The opposing distal end 1102 of tubular body 110 has a fixing ring 1114 affixed to, and circumscribing, the outer surface thereof. The end cap 170" is formed with an internal annular groove 196 into which the fixing ring 1114 is received to thereby establish a rotatable connection to the distal end 1102 of tubular body 110. End cap 170" is formed of a plastic material with a light transmissiveness ranging from transparent to varying levels of translucency to thereby emit illumination from the LED 154. The end cap 170" may be formed of a plastic material that is sufficiently elastic to permit the fixing ring 1114 to "snap" into the annular groove 196. Where a less elastic material is used, the end cap 170" may have two longitudinally separate halves that are assembled to the distal end 1102 of tubular body 110 and joined together thereat by any of a plurality of conventional means. Accordingly, to couple the opposing ends 1102 and 1104 of tubular body 110, the mouthpiece 120 is inserted into the internal bore 1766 of the end cap 170" through the opening 195, as indicated by directional arrow 103, and the end cap 170" is rotated to engage the internal threads 198 thereof with the external threads 202 of the connector 200. To uncouple the ends 1102 and 1104 of tubular body 110, the user simply rotates the end cap 170" in the opposite direction to thereby disengage the threaded connection.

Figure 8:
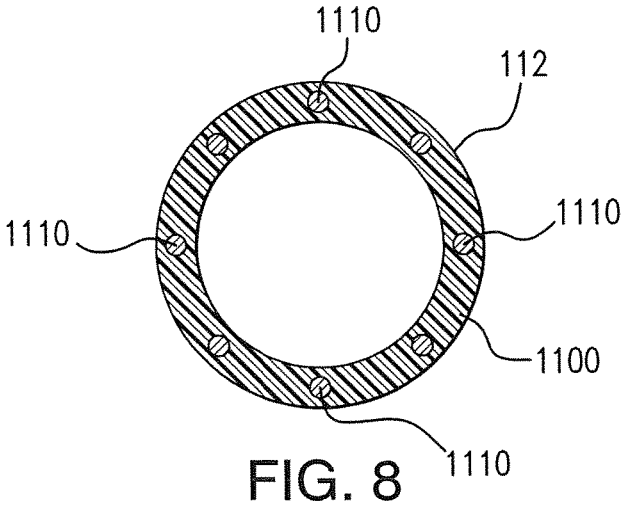
FIG. 8 is a cross-sectional view taken along the section line 8-8 of FIG. 2 showing a further alternate structure of the tubular body.

The bendable portion 112 of tubular body 110 may be formed of a variety of plastic or metallic materials and may encompass the entirety of tubular body 110. As shown in FIG. 8, the strength and/or elasticity of the bendable portion 112 of tubular body 110 may be improved by embedding a plurality of longitudinally extended wire members 1110 in the plastic wall 1100 to extend axially therein. The number, diameter, and material of wire members 1110 is selected as a function of the characteristics to be achieved.

Figure 3:
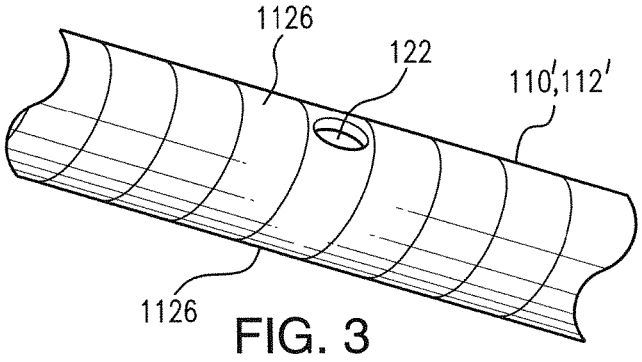
FIG. 3 is an enlarged partial view taken along the section line 3-3 in FIG. 2 showing an alternate structure of the tubular body.

Referring to FIG. 3, the wearable electronic simulated smoking device 100 may include a bendable portion 112' of a tubular body 110' formed of a metallic material where a strip of metal 1126 is helically wound in a partially overlapping manner to form the annular wall of the flexible tube. This type of construction is commonly referred to as a "gooseneck" tube or conduit. Where the "gooseneck" structure is being used, the air inlet opening 122 is formed through one of the metal strips 1126.

Figure 4:
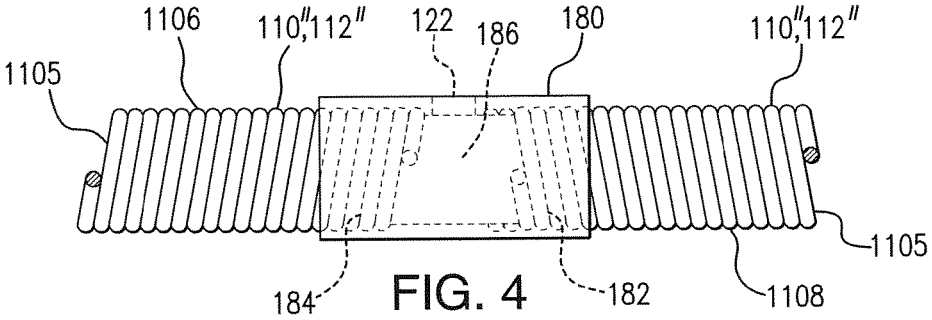
FIG. 4 is an enlarged partial view taken along the section line 4-4 in FIG. 2 showing an another alternate structure of the tubular body.

Another metallic construction is illustrated in FIG. 4. Here, the wearable electronic simulated smoking device 100 has bendable portions 112" of a tubular body 110" formed of at least two helical springs 1106 and 1108. Each spring 1106, 1108 when oriented for use of the device 100 is unbent and each spring has sufficient bias force between the helical turns of the wire 1105 to be substantially impervious to air when a user inhales through the tubular body 110". The two springs 1106 and 1108 are joined by an inlet connector 180. Inlet connector 180 has a cylindrical tubular contour with a through bore 186. The air inlet opening 122 is formed through the wall of inlet connector 180 and is in open communication with the through bore 186. Opposing ends of through bore 186 each have internal threads 182 and 184 into which the helically wound wire 1105 of the springs 1108 and 1106 are respectively threadedly engaged. The internal threads 184 may be right hand threads and the internal threads 186 may be left hand threads. The springs 1106 and 1108 are correspondingly wound (opposite to one another) so that both springs are simultaneously threadedly engaged responsive to rotation of the inlet connector 180 being rotated in one direction relative to both springs 1106 and 1108, as is done with a turnbuckle. Other methods of securing the inlet connector 180 to springs 1106 and 1108, such as adhesive bonding, welding, swaging, and the like may alternately be used. Similar methods may be employed to join the mouthpiece connector and end cap to the free ends of the springs 1106 and 1108.

Figure 1:
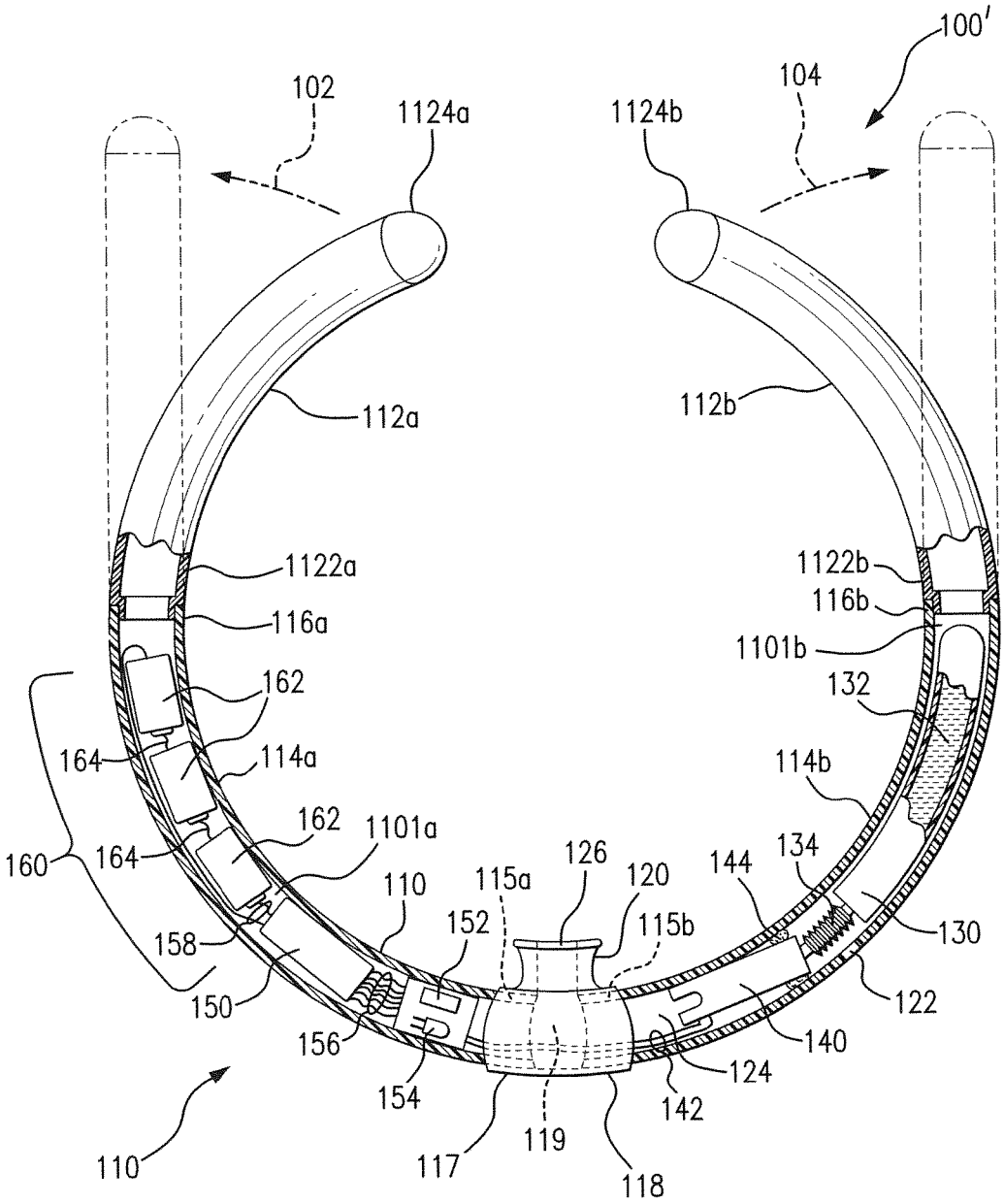
FIG. 1 is a schematic illustration, partially cut-away, of a configuration of the present invention.

Turning now to FIG. 1, there is shown a wearable electronic simulated smoking device 100' that has a configuration where at least a portion of the tubular body 110 has a fixed contour and at least another portion is bendable to change the contour thereof. The wearable electronic simulated smoking device 100' has a tubular body formed by bendable portions 112*a*, 112*b* and the portions 114*a*, 114*b* having a fixed arcuate contour. The fixed contour portions 114*a*, 114*b* may be formed of plastic or metallic materials, as can the bendable portions 112*a*, 112*b*, which bendable portions may be formed of materials and structures as previously described in preceding paragraphs. By that arrangement, the device 100' is able to at least partially encompass a portion of the user's body and be releasably retainable thereat to thereby provide both the electronic smoking function as well as serve as a fashionable ornament or accessory.

The operational components of wearable electronic simulated smoking device 100' are distributed within the internal bore 1101*a*, 1101*b* of the tubular portions 114*a* and 114*b*. The portions 114*a* and 114*b* are joined by a mouthpiece connector 118 that has a connector body 117 from which the mouthpiece 120 extends. Within the internal bore 1101*b* of arcuate portion 114*b* there is disposed a fluid container 130 with a supply of a liquid smoking composition 132 therein. The fluid container 130 is fluidly coupled to a nebulization chamber 140 by a flexible conduit 134. Nebulization chamber 140 is disposed in the fluid flow path 124 that extends from the air inlet opening 122, through the through bore 119 of mouthpiece connector 118, to the suction opening 126. As previously described, nebulization chamber 140 is provided with air inlet openings on a rear portion thereof (not shown) to allow air to be drawn therethrough. An annular seal 144 encompasses the nebulization chamber 140 to block air from bypassing passage through nebulization chamber 140. The descriptions of the components 130, 132, 134, and 140 and alternatives thereto apply to device 100' as well.

Within the internal bore 1101*a* of arcuate portion 114*a* there is disposed a sensor 152 in open fluid communication with the fluid flow path 124 for detecting a reduction in air pressure in fluid flow path 124 as an indication of a user drawing in air from the suction opening 126 of mouthpiece 120. Also in proximity to the fluid flow path 124 is an LED 154, which is illuminated when the sensor detects a user's inhalation and operation of the nebulization chamber 140 is initiated. The sensor 152 and LED 154 are connected to a controller 150 via corresponding pairs of a plurality of electrical wires 156. The controller 150 is provided to control the operation of the nebulization chamber 140 in response to inhalation by a user, as was described in preceding paragraphs and thus not repeated here. To enable the energization of the nebulization chamber 140 and LED 154, a power supply 160 is connected to controller 150 by means of a pair of electrical wires 158. Power supply 160 is formed by a plurality of batteries or cells 162 that may be connected in series, parallel, or a combination of series and parallel by means of one or more interconnection leads 164, as appropriate to the battery connection arrangement. Each interconnection lead 164 is a flexible electrical wire having a stranded or braided construction.

The mouthpiece connector 118 may be formed of a plastic material with a light transmissiveness ranging from transparent to varying levels of translucency to thereby emit illumination from the LED 154. Alternately, mouthpiece connector 118 may be formed of a metallic material with a light transmissive plastic insert incorporated therein to permit visualization of illumination from LED 154. The proximal end 115*a* of the arcuate portion 114*a* of tubular member 110 is received into the through bore 119 of the connector body 117 of mouthpiece connector 118 from one side thereof, and the proximal end 115*b* of arcuate portion 114*b* of tubular member 110 is likewise received into the through bore 119 from the opposing side of connector body 117. By that arrangement, the through bore 119 and the suction opening 126 therewith are placed in open communication with the fluid flow path 124 and the internal bore 1101*a* of the arcuate portion 114*a* of tubular member 110 so that the sensor 152 is able to sense air pressure changes in fluid flow path 124.

Figure 9:
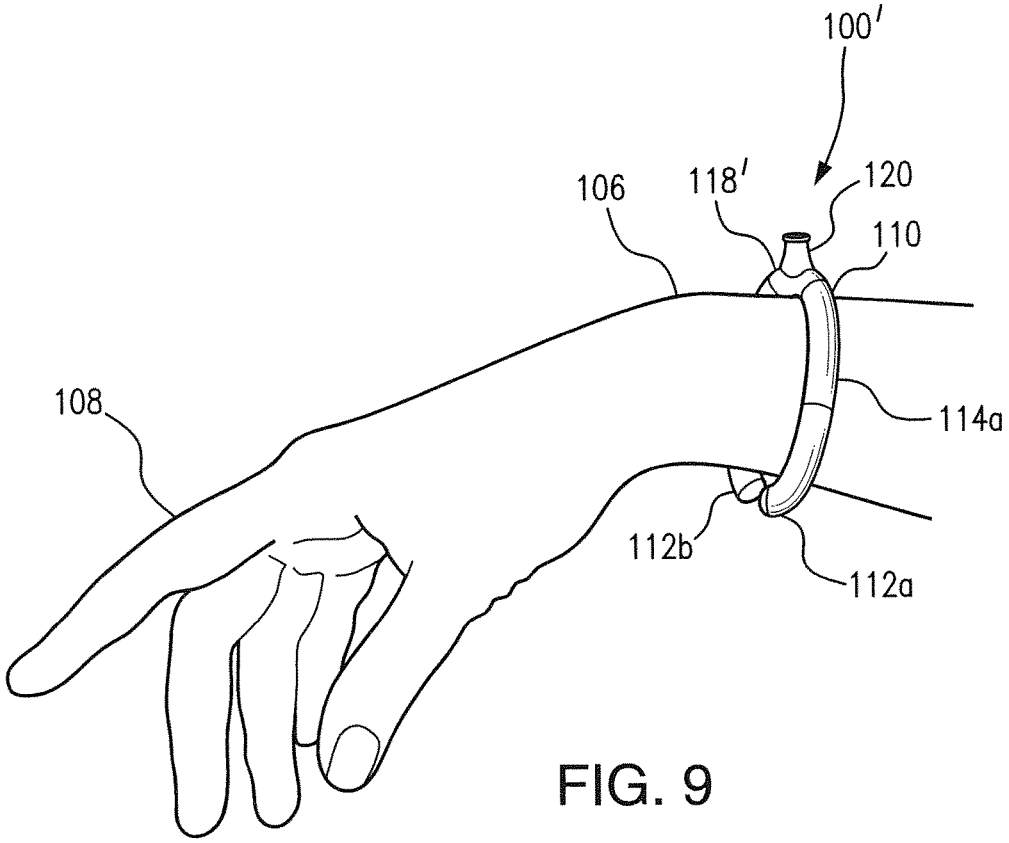
FIG. 9 is an illustration of a modification of the configuration shown in FIG. 1 to be worn on a user's wrist.

The mouthpiece 120 extending from the connector body 117 may be disposed at any angle relative to the plane established by the tubular body 110. When the electronic simulated smoking device 100' is to be worn about a user's neck, the angle of the mouthpiece 120 relative to the plane established by tubular body 110 is desirable to be within a range of 0 degrees, as illustrated in FIG. 1, to 180 degrees. If the diameter of the arcuate contour of the tubular body 110 is sufficiently large, the wearable electronic simulated smoking device 100' can conveniently be used without removal from the user's neck for an orientation of mouthpiece 120 relative to the plane established by tubular body 110 within a range of 0 degrees to 90 degrees. With reference to FIG. 9, when electronic simulated smoking device 100' is sized to be worn around a user's wrist 106 or finger 108, the angle of the mouthpiece 120 relative to the plane established by tubular body 110 is desirable to be within a range of 90 degrees to 270 degrees. A most convenient orientation for mouthpiece 120 in that application is at a substantially 180 degree angle, extending from the convex side of the arcuate contour of the tubular body 110.

Referring to both FIGS. 1 and 9, the bendable portions 112*a* and 112*b* respectively extend from the distal ends 116*a* and 116*b* of the arcuate portions 114*a* and 114*b*. Each of the bendable portions 112*a*, 112*b* have a proximal end 1122*a*, 1122*b* secured to the distal end 116*a*, 116*b* of the corresponding arcuate portion 114*a*, 114*b*. Each bendable portion 112*a*, 112*b* has a closed distal end 1124*a*, 1124*b*. The bendable portions 112*a* and 112*b* may be formed of the same materials and/or structure as the bendable portion of electronic simulated smoking device 100 discussed in preceding paragraphs. Accordingly, when a user wishes to encompass a portion of their body, such as their neck, wrist or finger, with the electronic simulated smoking device 100', the user bends the portions 112*a* and 112*b* outwardly, as indicated by direction arrows 102 and 104, and passes the tubular body 110 around the selected portion of the user's body. Once positioned, the user either releases the bendable portions 112*a* and 112*b* to return to their original arcuate contour and at least partially encompass the selected portion of the user's body, when bendable portions 112*a* and 112*b* have an elastic property, or manually bend the bendable portions 112*a* and 112*b* back into an arcuate contour sufficient to at least partially encompass the selected portion of the user's body and maintain the electronic simulated smoking device 100' thereat.

Figure 10:
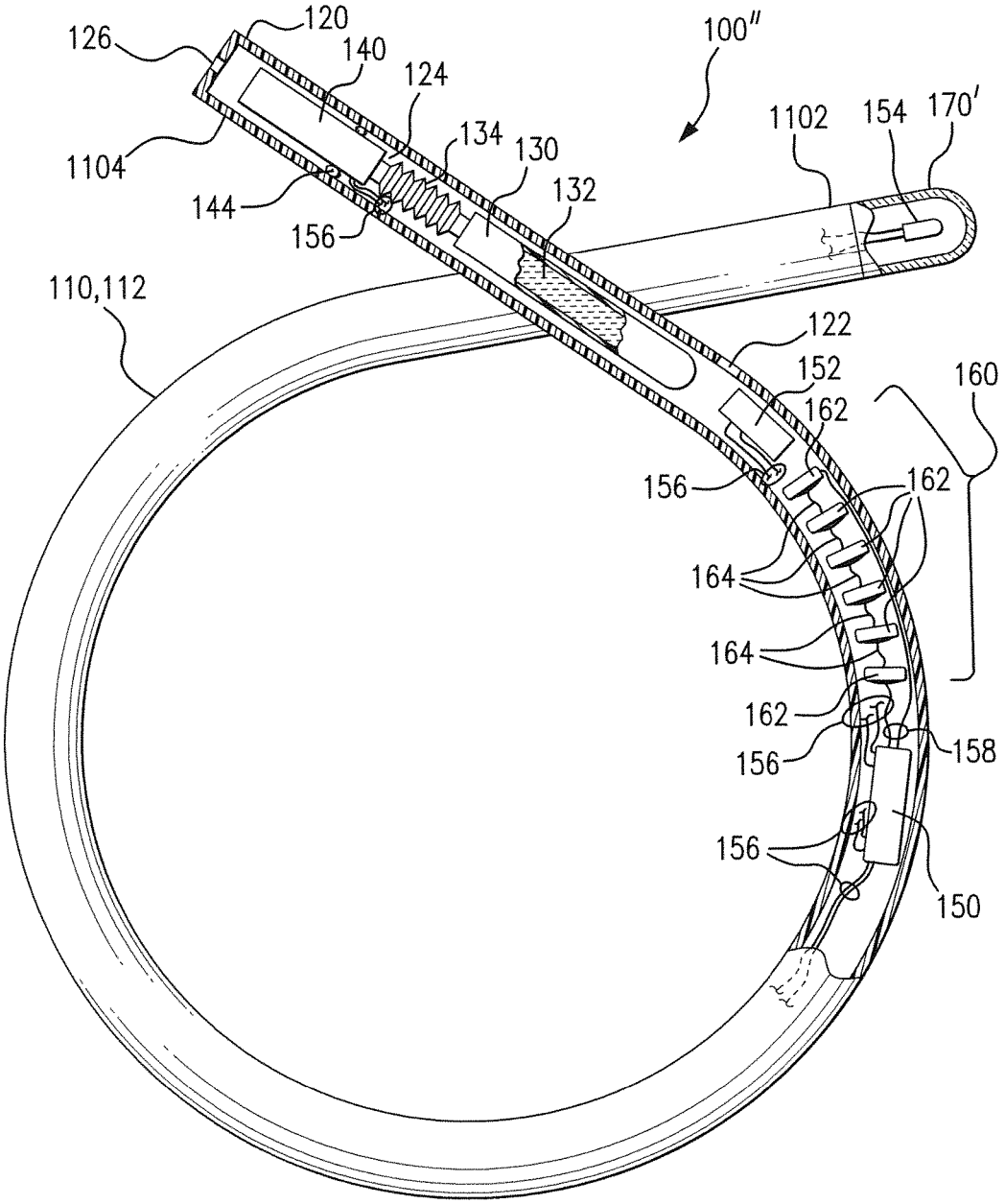
FIG. 10 is a schematic illustration, partially cut-away, of a further configuration of the present invention in a bent contour.
Figure 11:
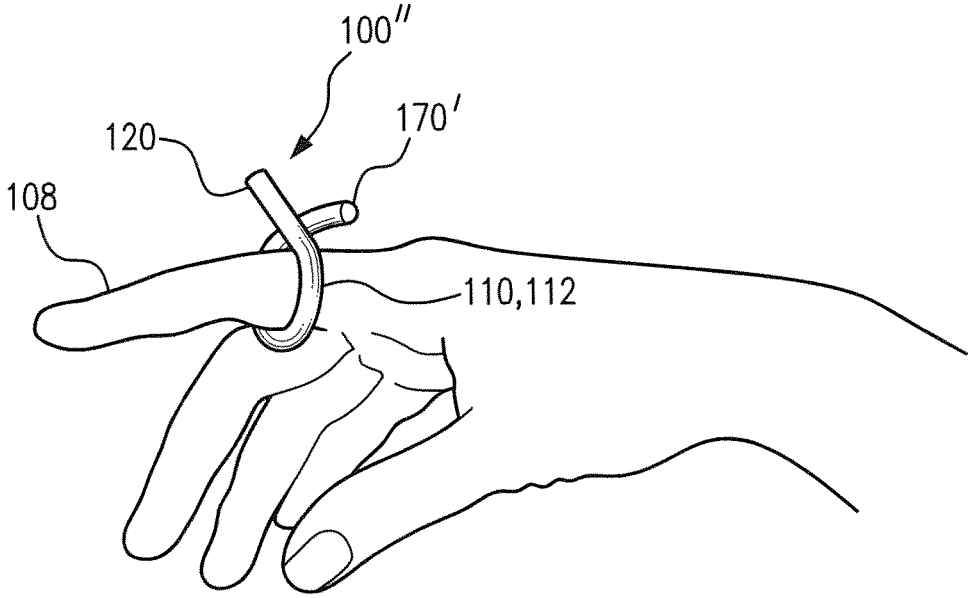
FIG. 11 is an illustration of the configuration shown in FIG. 10 being worn on a user's finger.
Figure 12:
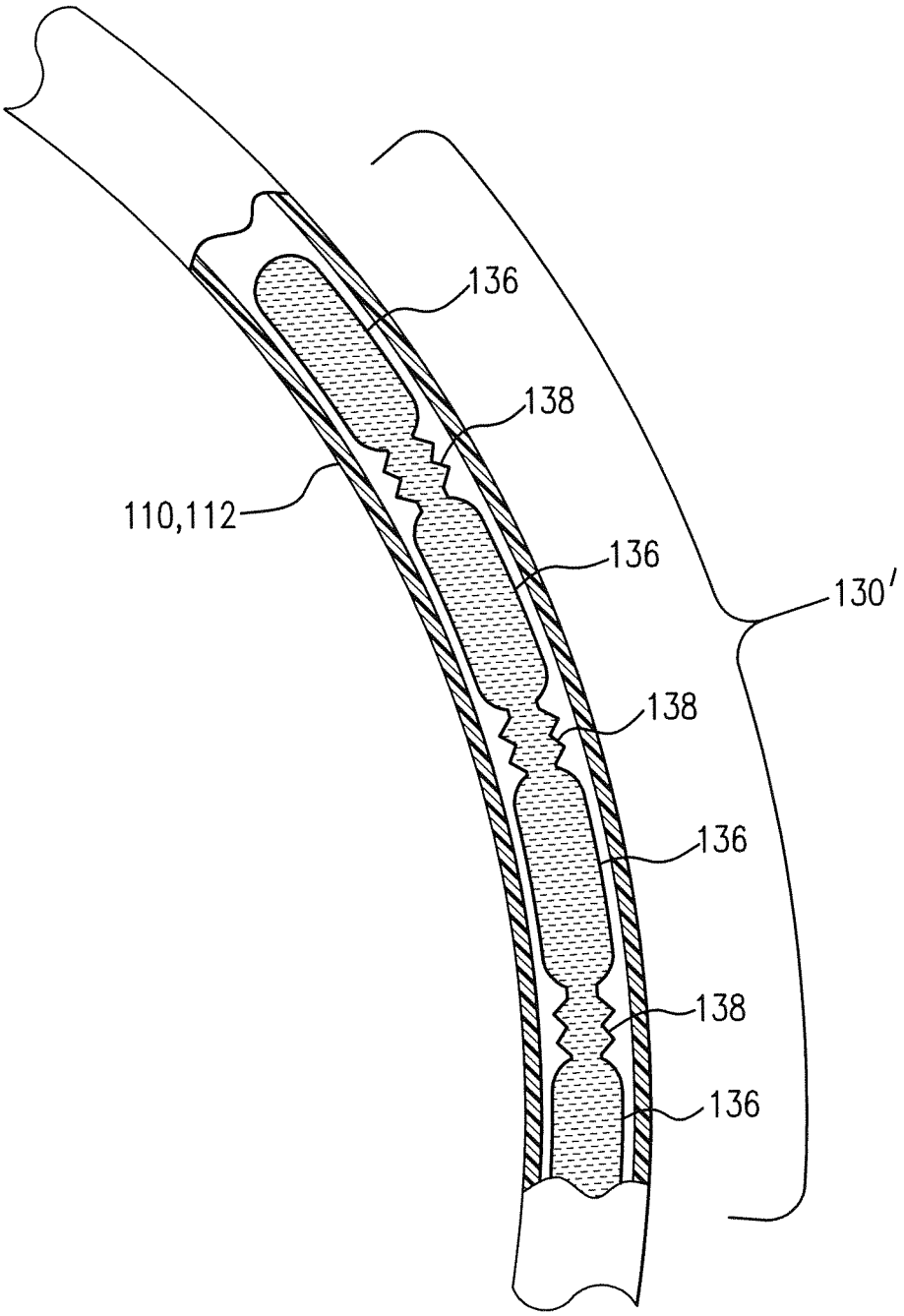
FIG. 12 is a sectional view taken along the section line 12-12 in FIG. 2 showing an alternate liquid container arrangement.

Turning now to FIGS. 10 and 11, there is shown wearable electronic simulated smoking device 100". The electronic simulated smoking device 100" is structurally identical to electronic simulated smoking device 100, previously described, but with a tubular body 110 that is elongated to a greater extent than would be the case for device 100 for use with the same selected portion of the user's body, and without the components that form the releasable coupling 280. Hence, a light transmissive end cap 170' is coupled to the distal end 1102 of tubular body 110 and a mouthpiece 120 is provided at the opposing end 1104. The extended length of tubular body 110 and the bendable portion 112 therewith, the bendable portion 112 being essentially coextensive with the entire tubular body 110, permits a user to wrap the tubular body 110 to form a closed loop about selected portions of the user's body and thereby is releasably retainable thereat. Thus, the tubular body 110 is able to fully encompass exemplary selected portions of the user's body as the neck, wrist or finger. As an example of the application of electronic simulated smoking device 100", FIG. 11 shows the device 100" being worn about a user's finger 108. As the releasable coupling is not required to retain the tubular body 110 about the user's finger 108, the user is able to easily access the mouthpiece 120 without the necessity of removing it from their finger.

Figure 13:
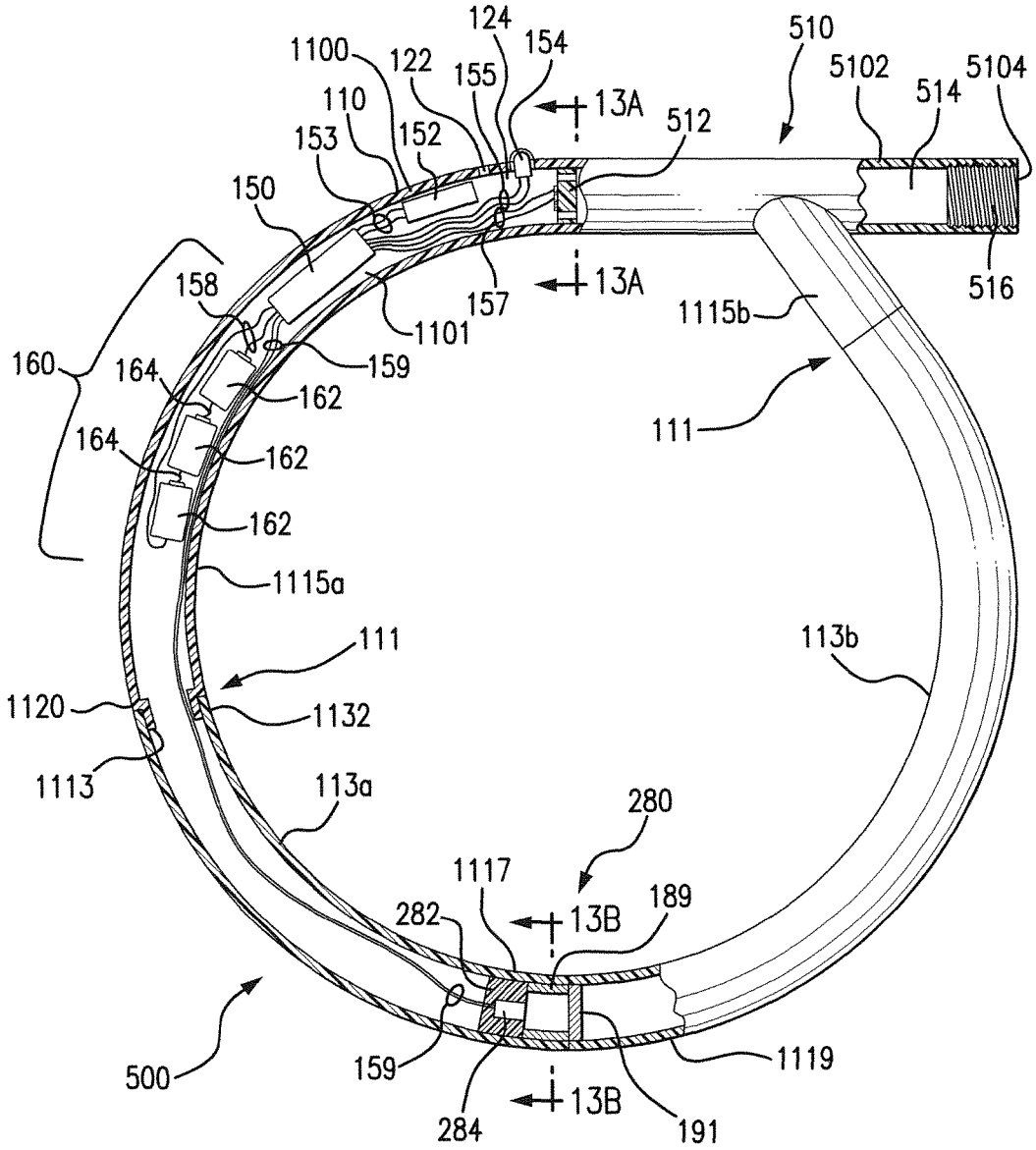
FIG. 13 is a schematic illustration, partially cut-away, of a configuration of the present invention having a cartridge receiving chamber incorporated therein.

Turning now to FIG. 13, there is shown a schematic illustration of a wearable electronic simulated smoking device 500 configured to utilize interchangeable vaporization cartridges 520, 520' and 520" (shown in FIGS. 14, 15 and 16) that are removably received within the cartridge receiving chamber 514 formed in the cartridge receiving housing 510. Wearable electronic simulated smoking device 500 is similar to wearable electronic simulated smoking device 100, previously described, and has many elements and features in common therewith. Common reference numbers have been used for such like elements and previously disclosed materials and suggested alternative therefore and suggested alternative construction of various component apply as well to device 500.

Wearable electronic simulated smoking device 500 includes an elongated tubular housing 110, portions of which 113*a* and 113*b* are reversibly bendable into, or out of, an arcuate contour. In the configuration shown, the bendable portions 113*a* and 113*b* connect to the more rigid portion 1115*a*, 1115*b* of tubular housing 110 at the joints 111. At joints 111, the flexible portions 113*a*, 113*b* are adhesively bonded to the corresponding ends of the more rigid portions 1115*a*, 1115*b*. As shown, the portion 1115*a* of tubular housing 110 has an arcuate contour, however, this is only exemplary and such may be a linearly extend portion of tubular housing 110 located in close proximity to the cartridge housing portion 510. As will be described in following paragraphs, the bendable portions 113*a*, 113*b* of tubular body 110 may be formed of various plastic or metallic materials having properties and/or structural arrangements providing the necessary pliancy to be reversibly bendable, either elastically or inelastically. Likewise, the cartridge receiving housing 510 may be formed of various plastic or metallic materials appropriate to the structural and thermal conditions to which it is to be exposed.

Wearable electronic simulated smoking device 500 includes a hollow tubular body 110 includes a portion thereof that forms a cartridge receiving housing 510. The cartridge receiving housing 510 includes a cartridge receiving chamber 514 in to which any one of multiple vaporization cartridges 520, 520', 520" may be removably received. The vaporization cartridges 520, 520', 520" included components that store a material to be vaporized, such as a liquid or wax composition, or a dry herbal material and provide the means to heat the material and deliver vapors therefrom to the air inhaled through the device by the user. The components within a vaporization cartridge that are combined with those maintained in the housing 110, together form the well known electronic simulated smoking device. As previously noted, the particular structures that form these electronic simulated smoking devices are well known in the art and therefore will not be described in detail, other than where modifications have been incorporated therein to accommodate particular features of the device disclosed herein.

Wearable electronic simulated smoking device 500 includes a controller 150 located within the internal bore 1101 of the tubular body 110 that controls the operation of the vaporization cartridge 520, 520', 520" in response to inhalation by a user. Such controllers are commonly used in conventional e-cigarettes and may be in the form of a microprocessor or a digital, analog or hybrid system on chip (SOC). Controller 150 has an input coupled to a sensor 152, disposed in the tubular body 110 adjacent the air inlet opening 122, formed through the wall 1100, via a pair of connecting electrical wires 153 connected to controller 150. The sensor 152 is located in fluid communication with the fluid flow path 124 for detecting a reduction in air pressure in fluid flow path 124, as an indication of a user drawing in air from the suction opening 126 of the mouthpiece 120 (shown in FIGS. 14, 15 and 16). Responsive to detection of the pressure drop, controller 150 outputs an energization signal through the electrical wires 157 that will be electrically coupled to an installed vaporization cartridge 520, 520', 520" for energizing a vaporizer therein to deliver a material vapor/air mixture to the user as the user inhales through the suction opening 126 of the mouthpiece 120.

Figure 13A:
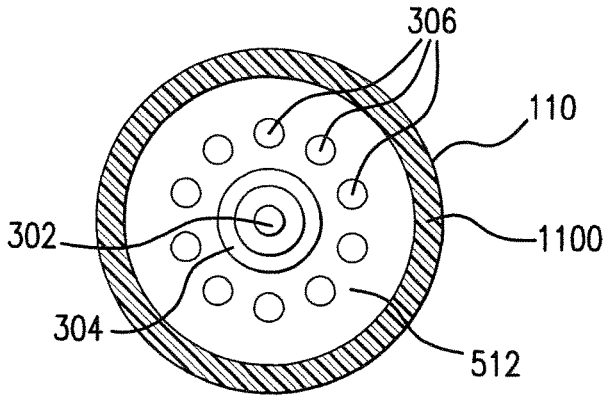
FIG. 13A is a cross-sectional view taken along the section line 13A-13A of FIG. 13.
Figure 13B:
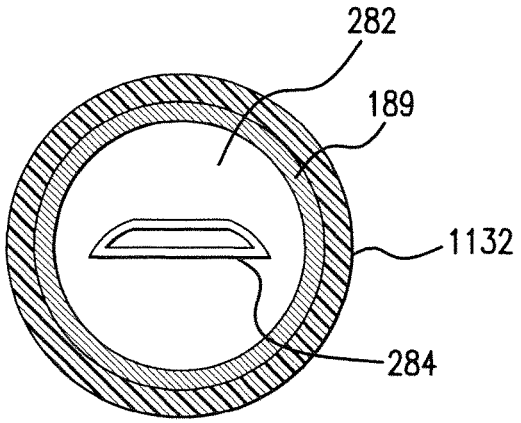
FIG. 13B is a cross-sectional view taken along the section line 13B-13B of FIG. 13.
Figure 13C:
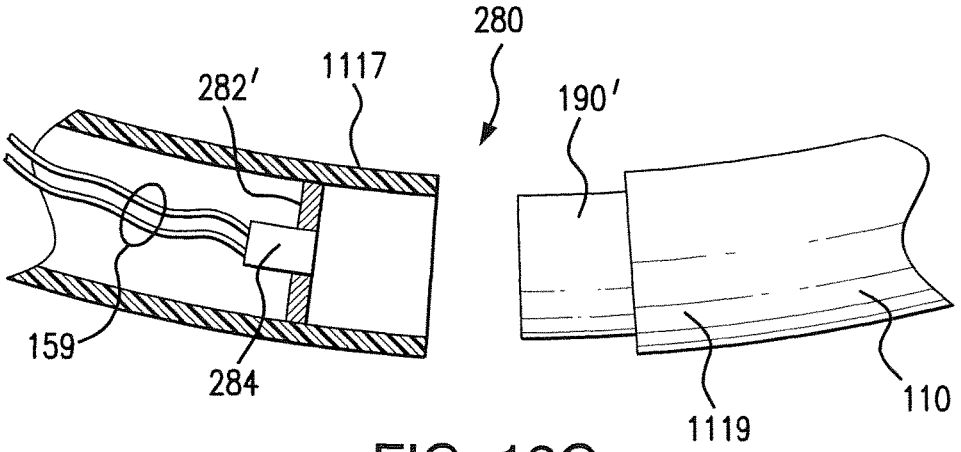
FIG. 13C is an enlarged partial view, partially sectioned to show a releasable coupling configuration.

Responsive to the detection of a user's inhalation by sensor 152, controller 150 energizes a light emitting diode (LED) 154 via another pair of electrical wires 155 connected to controller 150. LED 154 is disposed in an opening formed through the wall of tubular body 110 in proximity to the cartridge housing portion thereof, but could be located at any desired location. To enable the energization of the vaporization cartridge 520, 520', 520", controller 150 and LED 154, a power supply 160 is connected to controller 150 by means of a pair of wires 158. Power supply 160 is formed by a plurality of batteries or cells 162 that may be connected in series, parallel or a combination of series and parallel by means of one or more interconnection leads 164 (depending on the connection arrangement of the batteries). Power supply 160 may be formed by rechargeable battery cells with controller 150 controlling the recharging of the batteries responsive to an external power source providing power to controller 150. To facilitate charging, and with additional reference to FIG. 13B, the end portion 1117 of the tubular body 110 is fitted with an electrical connector 284 for coupling to an external power source. Electrical connector 284 may be a micro USB type connector so as to be compatible with common cell phone chargers that are commercially available. Connector 284 is mounted in an electrically insulated connector support member 282 recessed into the end 1117 of tubular body 110. Connector support member 282 may be recessed within the tubular body a distance in the approximate range of ¼ to ⅜ of an inch. Between the connector support member 282 and the open distal end of the end portion 1117, there is disposed an annular ring 189 formed of a ferromagnetic material that will form one part of a releasable coupling 280 which is illustrated as a magnetic clasp to join the two bendable portions 113*a* and 113*b* of tubular body 110 together after tubular body 110 has been place so as to encompass a portion of the user's body. Another part of the releasable coupling 280 is a magnet 191 installed in the distal open end of the end portion 1119 of tubular body 110. Magnet 191 may be disc shaped, as illustrated, annular, as shown in FIGS. 5 and 13C (described in following paragraphs), or any other contour appropriate for engagement of the annular ring 189.

The tubular body 110 with bendable portions 113*a* and 113*b* provides the ability of the electronic simulated smoking device 500 to be formed by a user into a contour that encompasses a portion of the user's body so that it can be worn as an ornament or an accessory. Depending upon the length and/or diameter of tubular body 110, device 500 can be worn about such body portions as the neck, wrist, arm, or finger, as examples. By this arrangement, the electronic simulated smoking device 500 can be conveniently carried by a user on the user's person; worn as a fashion accessory when not in use.

The coupling of the bendable portions 113*a* and 113*b* of tubular body 110 to the more rigid portions 1115*a*, 1115*b* can be by any conventional means. In the exemplary construction of tubular body 110, the more rigid portions 1115*a* and 1115*b* have a thickened wall section 1120 from which a lip 1113 of reduced diameter extends. While this construction is only illustrated in FIG. 13 with respect to the more rigid portions 1115*a*, it should be understood that the connection joints 111 are identical and thus the end portion of the more rigid portions 1115*b* is identical. Obviously, the length of the portion 1113*b* is a matter of design choice and can be reduced to the extent that it is incorporated into the cartridge housing or extended to match that of the portion 1115*a*, with a complementary arcuate contour. The extended lip 1113 of the portion 1115*a* has an outer dimension, in this case an outside diameter, to correspond to the inside dimensions (diameter) of the bendable portion 113*a* with which it mates. In this manner, the wall 1132 of the bendable portion 113*a* overlays the lip 1113 and may be bonded thereto by adhesive or ultrasonic bonding methods.

In a particular configuration of wearable electronic simulated smoking device 500, the more rigid portions 1115*a*, 1115*b* of tubular body 110 are located adjacent to, and in close proximity with the cartridge receiving housing 510. The bendable portions 113*a* and 113*b* of tubular body 110 extend from the interface with the respective more rigid portions 1115*a*, 1115*b* at the joints 111. The bendable portions 113*a* and 113*b* have an arcuate contour and are elastically bendable to permit separation of the tubular body's end portions 1117 and 1119, one from the other to enable a user to don device 500. Being elastic, the bendable portions 113*a* and 113*b* of tubular body 110 return to their original arcuate contour when the external force separating the end portions 1117 and 1119 is removed. The end portions 1117 and 1119 may include the releasable coupling 280, shown in FIGS. 13 and 13B, rely on the elastic force of the bendable portions 113*a* and 113*b* alone to act as a releasable coupling, or utilize the releasable coupling shown in FIG. 13C.

In FIG. 13C, the electrical connector 284 is supported within the end portion 1117 of tubular body 110 by a connector support member 282' formed of a ferromagnetic material. Connector support member 282' is recessed into the end 1117 of tubular body 110. Connector support member 282' may be recessed within the tubular body 110 a distance in the approximate range of ¼ to ⅜ of an inch, as an example. The end portion 1119 of tubular body 110 is fitted with an annular magnetic member 190' or alternately a cylindrical magnetic member. Magnetic member 190' may be formed by a magnet or an annular or cylindrical ferromagnetic member that is magnetically coupled to a magnet disposed in the end portion 1119 of tubular body 110. As shown in FIG. 13C, a portion of the annular magnetic member 190' extends from the end portion 1119 of tubular body 110 and is insertable into the corresponding end portion 1117 for magnetic coupling with the ferromagnetic connector support member 282' recessed therein. In addition to the magnetic coupling, magnetic member 190' may frictionally engage the inner wall surface of the end portion 117 of tubular body 110 to enhance the coupling between the end portions 1117 and 1119 of tubular body 110. It is also contemplated that the magnetic member 190' may be replaced by a projecting member to provide a releasable frictional coupling between the end portions 1117 and 1119 of tubular body 110.

In yet another configuration, the entire tubular body 110 is formed as a rigid structure with an arcuate contour and dimension to be worn as a "bangle" type bracelet. Thus, in this case, the tubular body forms a closed loop without the need for a releasable coupling. In this configuration, the electrical connector 284 is exposed through the wall tubular body 110.

The cartridge receiving housing portion 510 of the tubular body 110 includes a cartridge receiving chamber 514 with an open proximal end 5104 through which a selected one of the vaporization cartridges 520, 520', 520" is inserted. The cartridge receiving housing portion 510 may be provided with internal threads 516 adjacent to the open end 5104 for reversible engagement with complementary threads formed on the vaporization cartridges 520, 520' and 520". As will be described in following paragraphs, other forms of releasable coupling between the cartridge receiving housing 510 and the vaporization cartridges 520, 520' and 520" may be employed in the wearable electronic simulated smoking device 500.

The cartridge receiving housing portion 510 terminates at the distal end thereof at a first contact support member 512 formed of an electrically insulating material. The first contact support member 512 supports at least two electrical contacts that are connected to the electrical wires 157 that connect to the controller 150 for transmission of the energization signal to the installed vaporization cartridges 520, 520', 520". As shown in FIG. 13A, the first contact support member 512 is provided with a centrally located electrical contact 302 and an annular ring electrical contact 304. Where greater than two contacts are utilized, such additional contacts would be in the form of multiple concentric ring contacts with all of the contacts being scaled in size to accommodate the size of first contact support member 512. Where the cross-sectional contour of cartridge receiving housing portion 510 is other than circular, electrical contacts 302, 304 and any additional electrical contacts required may be aligned side-by-side, or be incorporated in a commercially available electrical connector. As the fluid flow path 124 must extend through the installed vaporization cartridges 520, 520', 520", first contact support member 512 is provided with through openings 306 allowing air to flow from the air inlet opening 122 therethrough.

Figure 14:
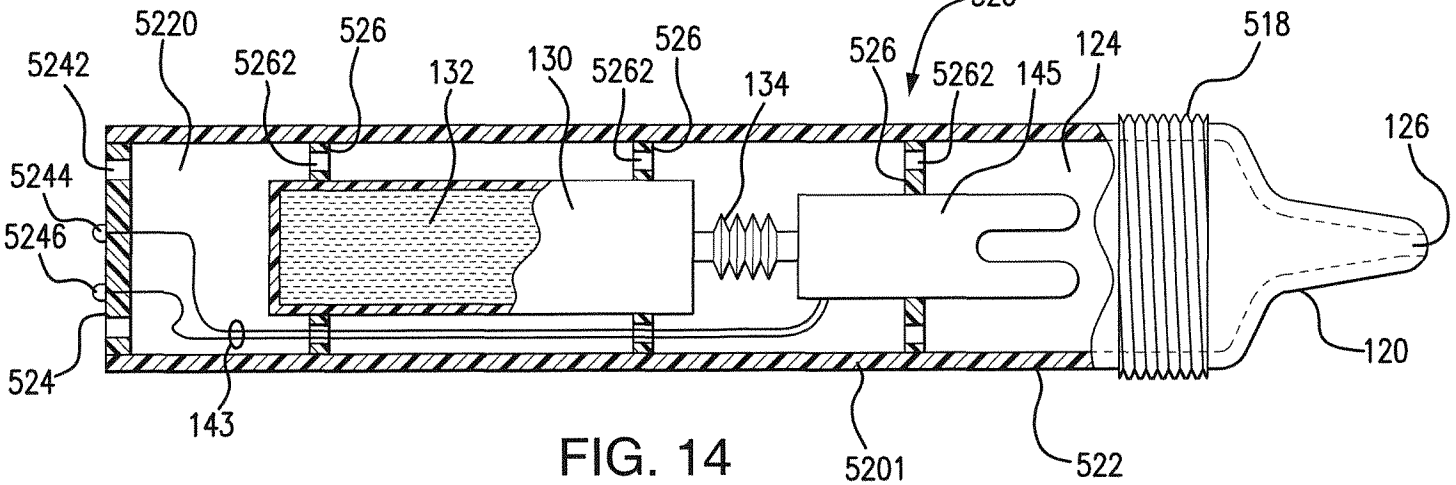
FIG. 14 is a schematic illustration, partially cut-away, of a configuration of a vaporization cartridge of the present invention.

Turning now to FIG. 14, the vaporization cartridge 520 is schematically illustrated. Vaporization cartridge 520 is designed to dispense vapors from liquid concentrates as has previously been described with respect to the wearable electronic simulated smoking device 100, 100' and 100". The vaporization cartridge 520 has a tubular housing 522 and includes a supply of a smoking liquid composition 132, as has previously been described, within a fluid container 130. The supply of the smoking liquid composition 132 may be stored as liquid within fluid container 130 or absorbed into a porous material disposed in fluid container 130. Fluid container 130 is supported within the internal bore 5220 of the cartridge housing 522 by one or more apertured support members 526. Each support member is provided with a plurality of air passage openings 5262 so that the fluid flow path 124 can extend between the vent opening 122 in the tubular housing 110 to the suction opening 126 in the mouthpiece 120. The smoking liquid composition 132 is output to the vaporization chamber 145. Vaporization chamber 145 may be a nebulization chamber, like the nebulization chamber 140 previously described or a vaporization system employing conduction or convection heating to produce vapors from the smoking liquid composition 132, as are well known in the art. The smoking liquid composition 132 is supplied to the vaporization chamber 145 through a conduit 134.

Vaporization chamber 145 is disposed in the internal bore 5220 of tubular housing 522 and supported therein by at least one apertured support member 526 with air passage openings. The apertured support members 526 may be formed of any suitable material. For example, the apertured support members 526, as well as many of the components of vaporization cartridges 520, 520', 520", can be formed of a high temperature plastic material, such as one of the commercially available ZYTEL® plastic materials available from E. I. du Pont de Nemours and Company, of Wilmington, Del.

The distal end of the housing 522 terminates in a second contact support member 524. Second contact support member 524 is formed of an electrically insulating material and supports at least two electrical contacts thereon. The at least two electrical contacts include a substantially centrally located electrical contact 5244 and a laterally spaced electrical contact 5246. The electrical contacts 5244 and 5246 are electrically connected to the vaporization chamber 145 by the electrical wires 143 for transmission of the energization signal. The centrally located contact 5244 will mate with the corresponding central contact 302 within the cartridge receiving chamber and the contact 5246 will mate with the annular ring contact 304 within the cartridge receiving chamber. Where the cartridge receiving housing 510 and the cartridge housing 522 have other than a circular cross-sectional contour and the contacts are standard electrical connectors, then a mating plug and jack will be supported by the first contact support member 512 and the second contact support member 524. The second contact support member 524 is also provided with a plurality of through openings 5242 to permit air flow into the internal bore 5220 of the cartridge housing 522.

The proximal end of the cartridge housing 522 has external threads 518 formed thereon that mate with the internal threads 516 of the cartridge receiving housing portion 510. The proximal end of the cartridge housing 522 terminates in a mouthpiece 120 that may be integrally formed thereat or joined thereto. The mouthpiece 120 has a suction opening 126 formed therethrough in open fluid communication with the internal bore 5220 and thereby with the fluid flow path 124. Thus, it can be seen that the fluid flow path 124 extends from the air inlet opening 122, through the first and second contact support members 512 and 524, through the apertured support members 526, past the outer wall of the fluid container 130, past, (and through if required) the vaporization chamber 145 to the suction opening 126 of the mouthpiece 120. If the vaporization chamber 145 is a nebulization chamber like that previously described where the fluid path 124 must pass therethrough, the apertured support member 526 shown in conjunction with vaporization chamber 145 would be replaced with the previously described annular seal 144.

Figure 15:
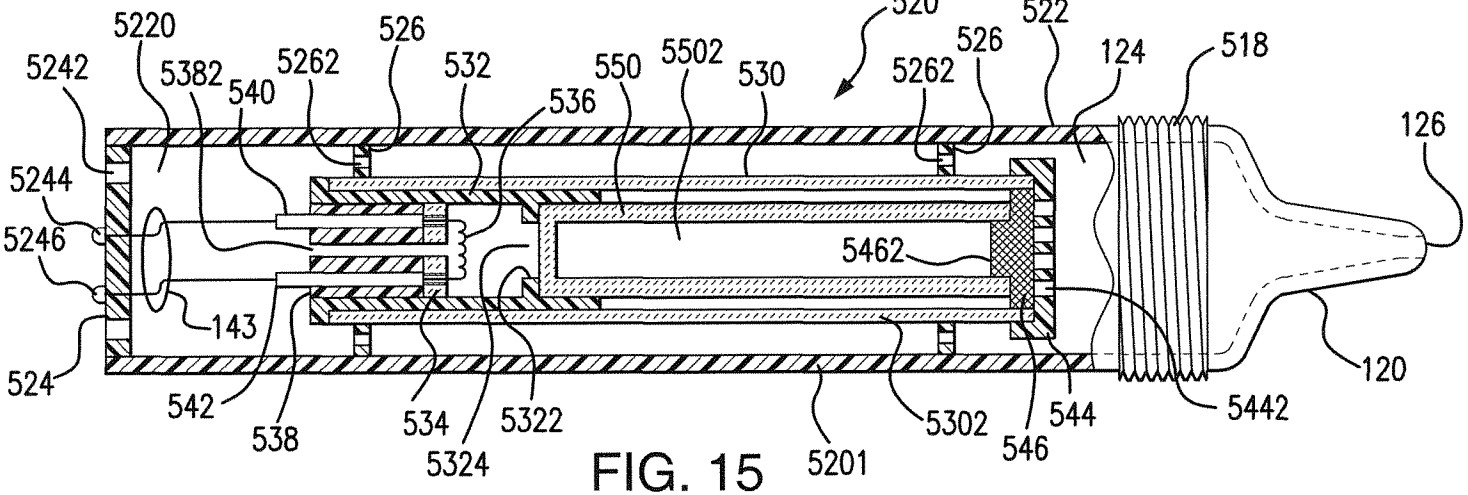
FIG. 15 is a schematic illustration, partially cut-away, of a configuration of another vaporization cartridge of the present invention.

Referring now to FIG. 15, there is shown a schematic illustration of a vaporization cartridge 520' designed to dispense vapors from dry herbal materials using a vaporizer 530. Vaporizers of this type are known in the art, such as is disclosed in U.S. Published Patent Application 2014/0041655, and thus the components of such will only briefly be described herein. The vaporization cartridge 520' has a tubular housing 522 and includes a material receptacle 550 having a cavity 5502 in which the dry herbal material is placed. The material receptacle 550 is located within the vaporizer 530 and may be formed of glass, ceramic or high temperature plastic materials. The vaporizer 530 has a tubular housing wall 5302 supported within the bore 5220 of the vaporization cartridge 520' by at least one apertured support member 526, having the same structure as that previously described.

Vaporizer 530 includes a heating chamber housing 532 that may be formed of a metal or ceramic material. Heating chamber housing 532 is disposed in the distal end of the vaporizer and has an internal annular rib 5322 to support the distal end of the material receptacle 550 within the internal bore 5324 of the heating chamber housing 532. Within the internal bore 5324 of the heating chamber housing 532 there is disposed a heater base 534 formed of a high temperature electrically insulative material, such as a ceramic material. The heater base 534 supports an electrical heating element 536 and has appropriate apertures through which the end portions of the heating element pass to connect with a pair of electrodes 540 and 542. Electrodes 540 and 542 are supported by an electrode insulator body 538. Electrode insulator body 538 is formed with a vent opening 5382 that corresponds with a vent opening formed through the heater base 534 to allow for venting of expansion of air that results from the heating within the heating chamber bore 5324. A mesh closure 546 is inserted into the proximal end of the vaporizer 530. The mesh closure 546 is pervious to air flow to allow the vapors emanating from the heated material receptacle to pass therethrough. The mesh closure 546 includes a supporting portion 5462 that extends into the material holding cavity 5502 to support the proximal end of the material receptacle 550 within the vaporizer housing 530. The proximal end of vaporizer 530 is overlaid by an end cap 544 having a plurality of apertures 5442 formed therein and through which the vapors generated within the vaporizer pass into the fluid flow pass 124.

The distal end of the housing 522 terminates in the second contact support member 524. Second contact support member 524 is identical to that described for the vaporization cartridge 520 above. The electrical contacts 5244 and 5246 are respectively electrically connected to the electrodes 540 and 542 of vaporizer 530 by the electrical wires 143 for transmission of the energization signal. As in the vaporization cartridge 520, the centrally located contact 5244 will mate with the corresponding central contact 302 within the cartridge receiving chamber and the contact 5246 will mate with the annular ring contact 304 within the cartridge receiving chamber. As previously described, the second contact support member 524 is also provided with a plurality of through openings 5242 to permit air flow into the internal bore 5220 of the cartridge housing 522.

The proximal end of the cartridge housing 522 has external threads 518 formed thereon that mate with the internal threads 516 if the cartridge receiving housing portion 510. The proximal end of the cartridge housing 522 terminates in the mouthpiece 120 and has a suction opening 126 formed therethrough in open fluid communication with the internal bore 5220 and thereby with the fluid flow path 124. Thus, hereto it can be seen that the fluid flow path 124 extends from the air inlet opening 122, through the first and second contact support members 512 and 524, through the apertured support members 526, past the outer wall of the vaporizer 530 to the suction opening 126 of the mouthpiece 120.

Figure 16:
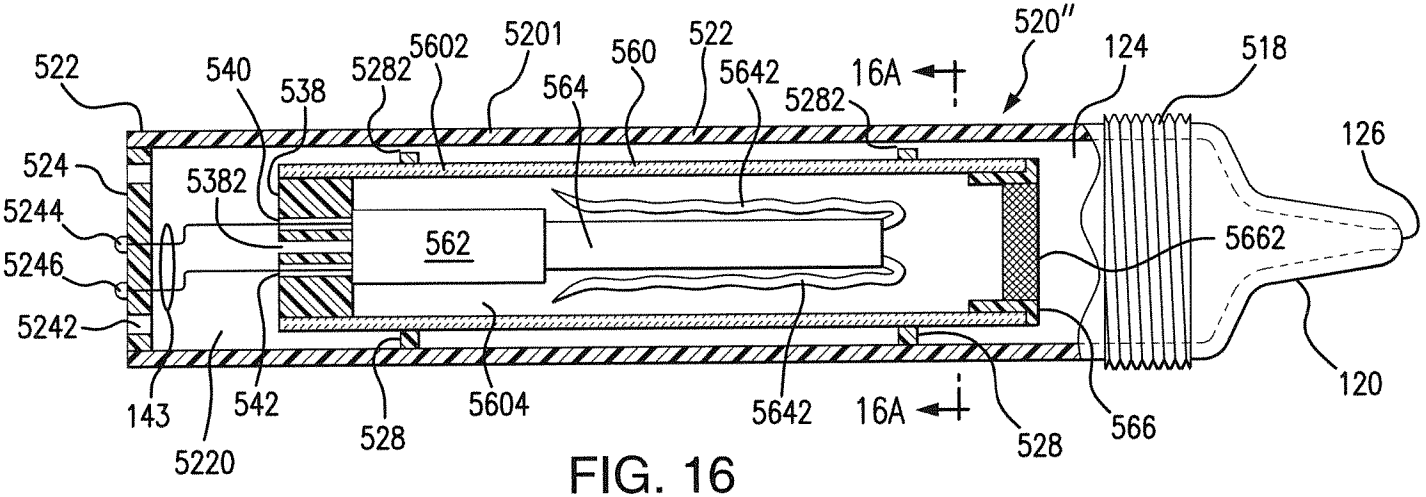
FIG. 16 is a schematic illustration, partially cut-away, of a configuration of another vaporization cartridge of the present invention.
Figure 16A:
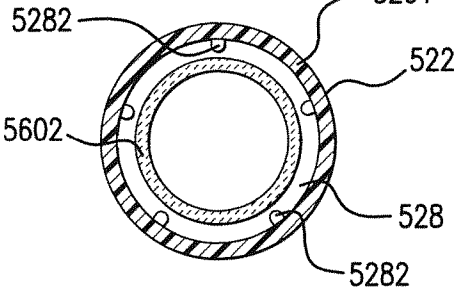
FIG. 16A is a cross-sectional view taken along the section line 16A-16A of FIG. 16.

FIG. 16 shows a schematic illustration of the vaporization cartridge 520" designed to dispense vapors from material that range in viscosity from liquid to wax using a vaporizer 560. Vaporizers of this type are also known in the art, and what's more disclosed in U.S. Published Patent Application 2014/0041655, and thus the components of such will only briefly be described herein. The vaporization cartridge 520" has a tubular housing 522 and includes heating chamber 562 and a material receptacle 564 disposed within the internal bore 5604 of vaporizer 560. The material receptacle 564 contains the material to be vaporized and may be provided with one or more wicks 5642 impregnated with a viscose material, such as wax, to be vaporized. The vaporizer 560 has a tubular housing wall 5602 supported within the bore 5220 of the vaporization cartridge 520" by at least one apertured support member 528. The structure of apertured support member 528 differs from apertured support member 526 only in the arrangement of the air passages formed therein. Apertured support member 526, as shown in FIG. 16A, includes air passage openings 5282 formed around the perimeter of the support member 528 and bounded by the inner surface of the cartridge wall 5220.

The heating chamber 562 of vaporizer 560 is electrically connected via the electrodes 540 and 542 disposed in the distal end of the vaporizer 560. Electrodes 540 and 542 are supported by an electrode insulator body 538. Electrode insulator body 538 is formed with a vent opening 5382 that corresponds with a vent opening of the heating chamber 562 to allow for venting of expansion of air that results from the heating within the heating chamber 562. An end cap 566 is inserted into the proximal end of vaporizer 560 to form a closure therefore. End cap 566 includes a mesh portion 5662. The mesh portion 5662 is pervious to air flow to allow the vapors emanating from the heated material receptacle 564 to pass therethrough into the fluid flow pass 124.

The distal end of the housing 522 terminates in the second contact support member 524. Second contact support member 524 is identical to that described for the vaporization cartridges 520 and 520', above. The electrical contacts 5244 and 5246 are respectively electrically connected to the electrodes 540 and 542 of vaporizer 560 by the electrical wires 143 for transmission of the energization signal. As in the vaporization cartridges 520 and 520', the centrally located contact 5244 will mate with the corresponding central contact 302 within the cartridge receiving chamber and the contact 5246 will mate with the annular ring contact 304 within the cartridge receiving chamber. As previously described, the second contact support member 524 is also provided with a plurality of through openings 5242 to permit air flow into the internal bore 5220 of the cartridge housing 522.

The proximal end of the cartridge housing 522 has external threads 518 formed thereon that mate with the internal threads 516 of the cartridge receiving housing portion 510. The proximal end of the cartridge housing 522 terminates in the mouthpiece 120 and has a suction opening 126 formed therethrough in open fluid communication with the internal bore 5220 and thereby with the fluid flow path 124. Thus, hereto it can be seen that the fluid flow path 124 extends from the air inlet opening 122, through the first and second contact support members 512 and 524, through the apertured support members 528, past the outer wall of the vaporizer 560 to the suction opening 126 of the mouthpiece 120.

Figure 18:
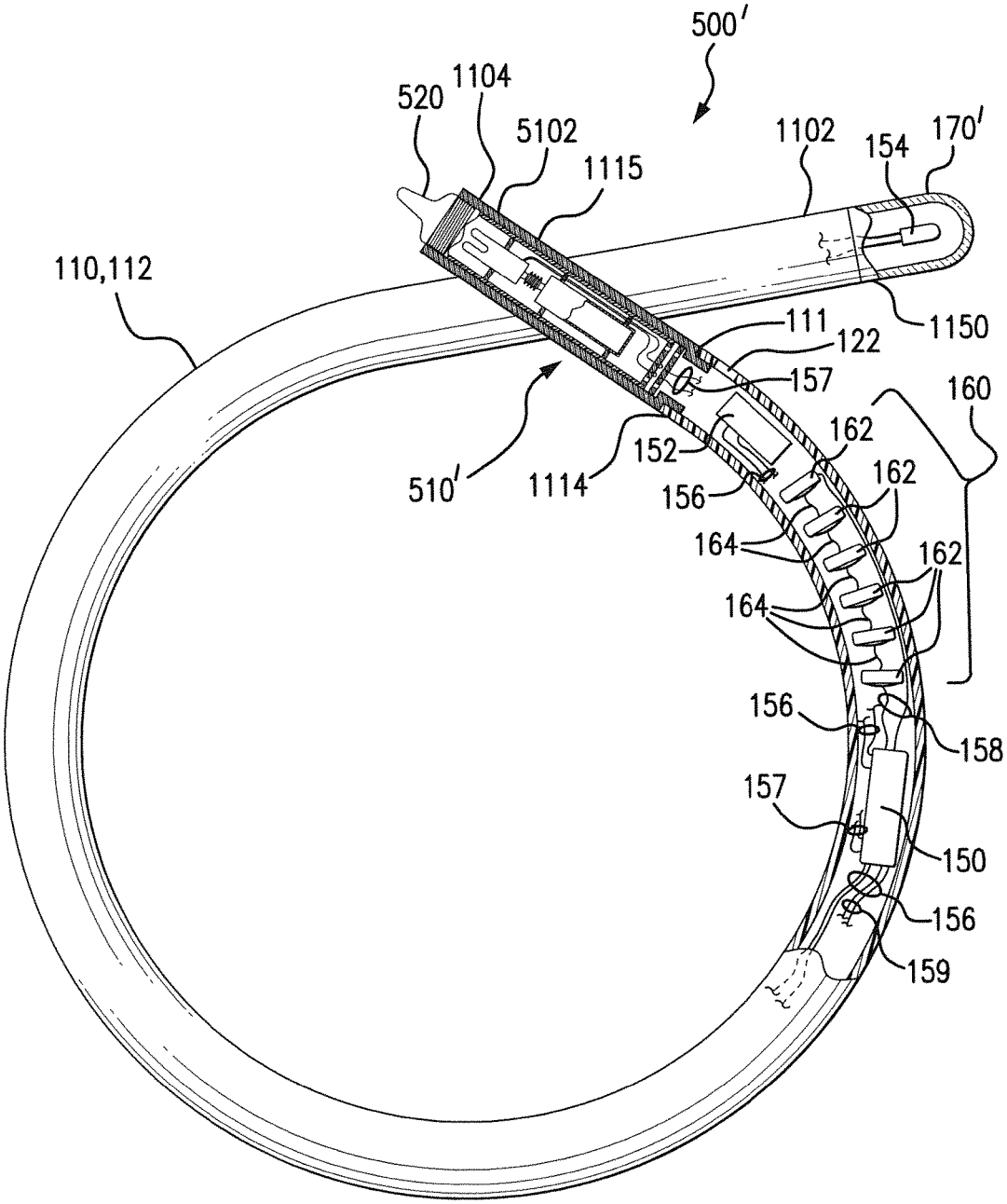
FIG. 18 is a schematic illustration, partially cut-away, of a still further configuration of the present invention adapted to be in a bent contour and having a cartridge receiving chamber incorporated therein.

Referring to FIG. 18, there is shown wearable electronic simulated smoking device 500'. The wearable electronic simulated smoking device 500' is structurally identical to wearable electronic simulated smoking device 500, previously described, but with a tubular body 110 that is elongated to a greater extent than would be the case for device 500 for use with the same selected portion of the user's body, and without the components that form the releasable coupling 280. Hence, a light transmissive end cap 170' is coupled to the distal end 1102 of tubular body 110 and a cartridge receiving housing 510' is provided at the opposing end 1104. An extended length of tubular body 110 and the bendable portion 112 therewith, the bendable portion 112 being essentially coextensive with all of the tubular body 110 except the portion defining the cartridge receiving housing 510', which permits a user to wrap a substantial portion of the tubular body 110 to form a closed loop about selected portions of the user's body and thereby is releasably retainable thereat.

Thus, the tubular body 110 is able to fully encompass exemplary selected portions of the user's body as the neck, wrist or finger. As in the wearable electronic simulated smoking device 500, the more rigid portion 1115 of tubular body 110 is joined to the bendable portion 112 at the joint 111. The structure of joint 111 is like that previously described for the wearable electronic simulated smoking device 500. The light transmissive end cap 170' may be part of a removable closure 1150 to expose the recharge connector 284 (shown in FIG. 13) mounted to be recessed in the end 1102 of tubular housing 110. For example, where the recharge connector is a micro USB connector, such has four conductors, two for battery recharging current and two for powering the LED 154. Removable closure 1150 would therefore include a mating USB connector and the frictional engagement between the USB plug and jack is sufficient to maintain removable closure 1150 in place until manually removed by the user.

Figure 17:
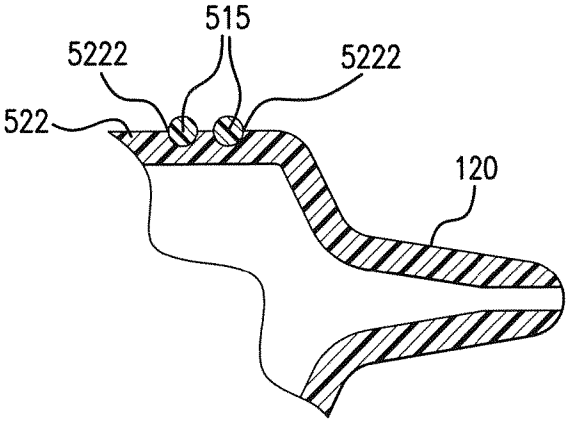
FIG. 17 is partial sectional view of the vaporization cartridge of the present invention showing an alternate releasable coupling arrangement.

While the threaded coupling between the cartridge receiving housing 510, 510' and the vaporization cartridge 520, 520', 520" has been described for the wearable electronic simulated smoking device 500, 500', other systems may be used to provide the removable coupling of the vaporization cartridge 520, 520', 520". One example of an alternate system for removable coupling of the vaporization cartridge 520, 520', 520" is shown in FIG. 17. In place of the external threads 518, the vaporization cartridge 520, 520', 520" are provided by one or more recesses 5222 into which one or more O-rings 515 are respectively received. The internal threads 516 of the cartridge receiving housing 510, 510' are simply eliminated so that the entire cartridge receiving chamber 514 is bounded by a smooth wall surface. Any other method of providing a removable coupling that also provides an air seal between the vaporization cartridge 520, 520', 520" and the cartridge receiving housing 510, 510' may be used as well.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features. In certain cases, particular locations of elements may be reversed or interposed, all without departing from the spirit or scope of the invention as defined in the appended Claims. The scope of the invention should therefore be determined with reference to the description above, the appended claims and drawings, along with their full range of equivalents.

What is being claimed is:

1. A wearable electronic simulated smoking device, comprising:

an elongated tubular body configured to at least partially encompass a portion of a user's body, said tubular body having at least one bendable portion, at least one fixedly arcuate shaped portion and a linearly extended cartridge receiving chamber formed in the tubular body;

a power supply disposed in said tubular body, said power supply being formed by a plurality of battery cells each being individually displaceable to conform to an interior space of one of the arcuate shaped portion or the bendable portion;

a vaporization cartridge removably received within said cartridge receiving chamber; and a controller disposed in said tubular body and coupled to said power supply, said controller outputting an energization signal to said vaporization cartridge to control power delivered thereto, wherein said vaporization cartridge includes:

a housing configured for releasable coupling to said cartridge receiving chamber, said housing having a perforate first end configured for electrical coupling to said controller, a suction opening at an opposing second end and a fluid flow path extending therebetween;

a vaporizer including a heat source and a supply of a vaporizable material, said heat source vaporizing said vaporizable material responsive to said energization signal, said vaporizer being disposed in fluid communication with said fluid flow path for dispensing vapors from vaporizable material to said fluid flow path.

2. The wearable electronic simulated smoking device as recited in claim 1, where said housing of said vaporization cartridge is threadedly engaged with said cartridge receiving chamber to provide said releasable coupling therewith.

3. The wearable electronic simulated smoking device as recited in claim 1, where said housing of said vaporization cartridge is frictionally engaged with said cartridge receiving chamber to provide said releasable coupling therewith.

4. The wearable electronic simulated smoking device as recited in claim 3, where said frictional engagement is provided by at least one o-ring disposed on said housing.

5. The wearable electronic simulated smoking device as recited in claim 1, where said supply of a vaporizable material is disposed in a receptacle within said vaporization cartridge, said receptacle holding a composition selected from a dry herb material and a concentrate in a liquid or wax form.

6. The wearable electronic simulated smoking device as recited in claim 1, where said at least one bendable portion is elastically bendable.

7. The wearable electronic simulated smoking device as recited in claim 1, where said plurality of battery cells are interconnected by flexible electrical conductors.

8. The wearable electronic simulated smoking device as recited in claim 7, where said flexible electrical conductors are formed of stranded or braided wire conductors.

* * * * *